US005934816A

United States Patent [19]

Bruttomesso

[11] Patent Number: 5,934,816

[45] Date of Patent: Aug. 10, 1999

[54] GROUT SEALANT LIQUID APPLICATOR

[76] Inventor: Roger S. Bruttomesso, 683 104th Ave. North, Naples, Fla. 34108

[21] Appl. No.: 09/027,747

[22] Filed: Feb. 23, 1998

[51] Int. Cl.[6] ..... B05C 17/00

[52] U.S. Cl. ..... 401/208; 401/218; 401/219

[58] Field of Search ..... 401/268, 218, 401/220, 219, 210, 213

[56] References Cited

U.S. PATENT DOCUMENTS

| | | | |
|---|---|---|---|
| 665,336 | 1/1901 | Meier et al. | 401/218 |
| 2,721,347 | 10/1955 | Benkowski | 401/208 |
| 3,028,868 | 4/1962 | Tandler, Jr. | 401/219 |
| 4,212,556 | 7/1980 | Kohler . | |
| 5,109,798 | 5/1992 | Impastato et al. | 401/208 |
| 5,302,043 | 4/1994 | Velliquette . | |

*Primary Examiner*—David J. Walczak

[57] ABSTRACT

A grout-sealant-liquid applicator has a fluid-conveyance cap (1) with a container end (2) attachable to an outlet from a container of grout sealant and having an applicator end (3) with an applicator nozzle (9) positioned near an outside circumferential liquid-conveyance surface (7) of an applicator wheel (4) on a wheel-attachment bracket (6, 17) proximate the applicator end. The wheel-attachment bracket has snap-on axle bays (14) for convenient insertion and removal of applicator-wheel wheel axles having select widths, diameters, surface configuration and sealant absorbability.

7 Claims, 2 Drawing Sheets

GROUT SEALANT LIQUID APPLICATOR

BACKGROUND OF THE INVENTION

1. Field of the Invention.

This invention relates to wheel types of applicators of grout-sealant liquids to grout at edges of tiling.

2. Relation To Prior Art

Tile-laying artisans and do-it-yourselfers conventionally have used various types of paint strippers to apply liquid sealant to grout-containing spaces between and at edges of tiling. Thin and highly viscose grout sealant requires a different type of applicator than for lower-viscose and thicker characteristics of paint.

Examples of different but related wheel-types of stripping applicators are described in the following patent documents. U.S. Pat. No. 4,212,556, issued to Kohler, described a wheel type of paint stripper that was limited to slots like spur gears or other paint-container cavities on circumferential peripheries of circumferentially sectioned stripper wheels that allowed escape and drying of more viscose grout sealant before it could be applied effectively to grout spaces.

U.S. Pat. No. 5,302,043, issued to Velliquette, described a wheel type of grout-sealant applicator having a porously absorbent wheel positioned between washer-like non-porous disks with slightly smaller diameters to prevent escape of viscose grout sealant. Problems in applying grout with known applicators continue to exist, however.

SUMMARY OF THE INVENTION

In light of these problems, objects of patentable novelty and utility taught by this invention are to provide a grout-sealant-liquid applicator which:

Does not allow viscose grout sealant to escape while being conveyed from a sealant-dispenser orifice to grout spaces at edges of slabs of tiling;

Applies grout sealant evenly without oversupply or undersupply along grout lines;

Prevent side travel of sealant onto surfaces of tile;

Applies sealant to tile-edge walls that may exist at sides of grout spaces;

Can be adapted quickly and easily to different widths of grout spaces;

Is quickly and easily cleanable;

Is inexpensive to produce; and

Can be adapted to a wide selection of sealant containers and dispensers.

This invention accomplishes these and other objectives with a grout-sealant-liquid applicator having a fluid-conveyance cap with a container end attachable to an outlet from a container of grout sealant and having an applicator end with an applicator nozzle positioned near an outside circumferential periphery of an applicator wheel on a wheel-attachment bracket proximate the applicator end. The wheel-attachment bracket has snap-on axle bays for convenient insertion and removal of applicator axles having applicator wheels with select widths, diameters, surface configuration and sealant absorbability.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Figure 1:
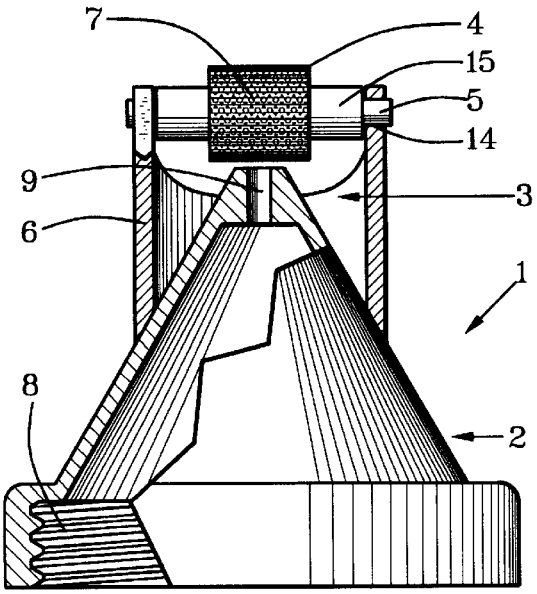
FIG. 1 is a partially cutaway front elevation view of an embodiment with threaded attachment to a container and with stationary wheel-attachment brackets.

Terms used to describe features of this invention are listed below with numbering in the order of their initial use with reference to the drawings. These terms and numbers assigned to them designate the same features wherever used throughout this description.

1. Fluid-conveyance cap
2. Container end
3. Applicator end
4. Applicator wheel
5. Applicator axle
6. Wheel-attachment bracket
7. Liquid-conveyance surface
8. Threaded container attachment
9. Applicator nozzle
10. Snap-on container attachment
11. Snap-on hub
12. Snap-on ridges
13. Snap-on cap
14. Axle bays

15. Axle shoulders
16. Removable applicator wheel
17. Machine-threaded attachment
18. Nozzle-width inserts
19. Outlet-width orifices
20. Nozzle-width insert tubes
21. First flow-control insert
22. Second flow-control insert Reference is made first to FIGS. 1–3. A fluid-conveyance cap 1 that is preferably truncate conical has a container end 2 and an applicator end 3. The applicator end 3 has an applicator wheel 4 positioned concentrically and centrally on an applicator axle 5 that is attached detachably to a wheel-attachment bracket 6. The applicator wheel 4 has an outside circumferential periphery with a liquid-conveyance stuface 7. The container end 2 has a threaded container attachment 8 and the applicator end 3 has an applicator nozzle 9.

Figure 2:
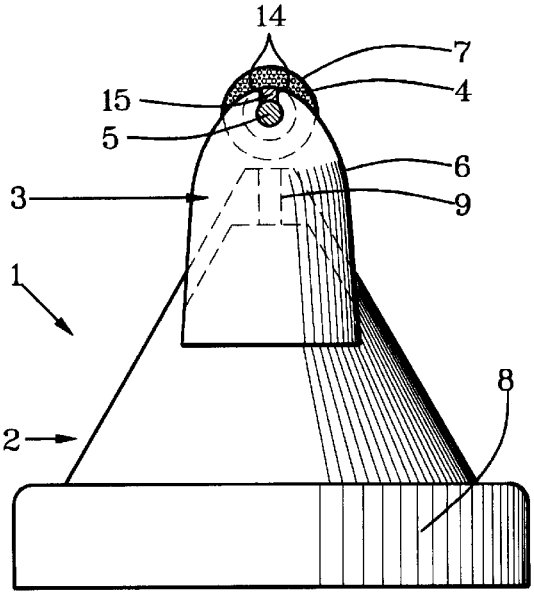
FIG. 2 is a side elevation view of the FIG. 1 illustration.
Figure 3:
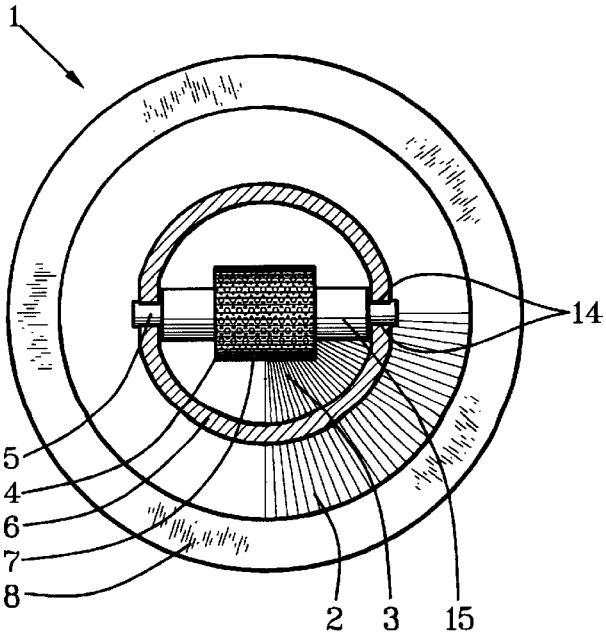
FIG. 3 is a top view of the FIG. 1 illustration.
Figure 4:
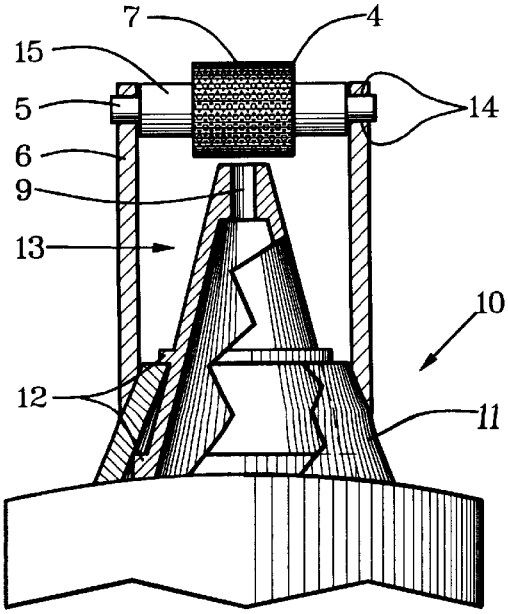
FIG. 4 is a partially cutaway side elevation view of an embodiment with snap-on attachment to a container.

Referring to FIG. 4, a snap-on container attachment 10 with a snap-on hub 11 and snap-on ridges 12 on a snap-on cap 13 can be used in lieu of the threaded container attachment 8 described in relation to FIGS. 1–3.

Referring to FIGS. 1–4, opposite ends of the applicator axle 5 are snap-attached detachably with snap-fit into axle bays 14 having distances across entrance portions of the axle bays 14 that are slightly shorter than diameters of the applicator axle 5. Intermediate the applicator axles 5 and the applicator wheels 4 are axle shoulders 15 that are nonabsorbent and restrict lateral flow of fluid from the applicator wheel.

Figure 5:
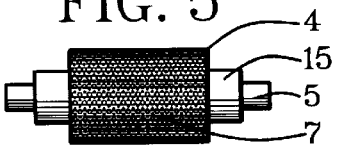
FIG. 5 is a front view of a proportionately wide applicator wheel on an applicator axle.
Figure 6:
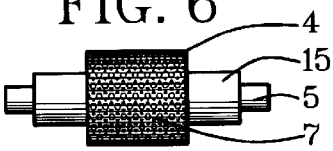
FIG. 6 is a front view of a proportionately medium-width applicator wheel on an applicator axle.
Figure 7:
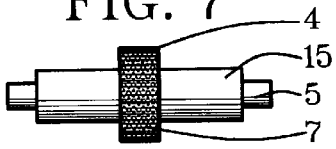
FIG. 7 is a front view of a proportionately narrow applicator wheel on an applicator axle.
Figure 8:
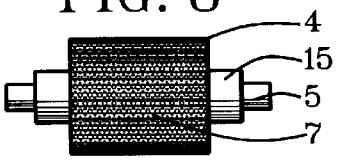
FIG. 8 is a front view of a proportionately large-diameter and wide applicator wheel on an applicator axle.
Figure 9:
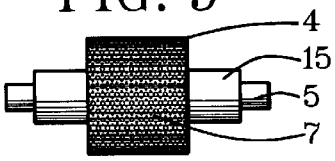
FIG. 9 is a front view of a proportionately large-diameter and medium-width applicator wheel on an applicator axle.
Figure 10:
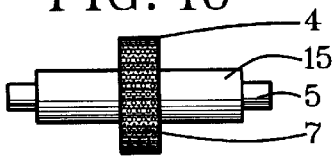
FIG. 10 is a front view of a proportionately large-diameter and narrow applicator wheel on an applicator axle.

Referring to FIGS. 5–10, a plurality of applicator wheels 4 can be provided with different widths as depicted in FIGS. 5–7, different diameters as depicted in FIGS. 8–10 and different widths in combination with different diameters as depicted also in FIGS. 5–10. Different liquid-conveyance surfaces 7 are referenced but not shown separately. This provides selection of applicator wheels 4 for applying liquid sealant to different widths, depths and types of grout in spaces between and at edges of tiling.

Figure 11:
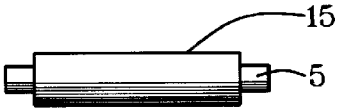
FIG. 11 is a front view of an applicator axle to which a wide selection of removable applicator wheels are attachable.
Figure 12:
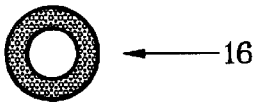
FIG. 12 is a side view of a removable applicator wheel having a proportionately small outside diameter.
Figure 13:
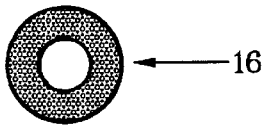
FIG. 13 is a side view of a removable applicator wheel having a proportionately large outside diameter.

Referring to FIGS. 11–13, an applicator axle 5 can be provided with axle shoulders 15 onto which removable applicator wheels 16 with proportionately small outside diameters as depicted in FIG. 12 or with proportionately large outside diameters as depicted in FIG. 13 are positioned removably. Except for permanency of positioning of applicator wheels 4 on applicator axles 5 in FIGS. 5–10 embodiments and removability of removable applicator wheels 16 from applicator axles 5 in FIGS. 11–13 embodiments, the removable applicator wheels 16 on axle shoulders 15 of applicator axles 5 can be and are shown to be the same as the applicator wheels 4 in FIGS. 5–10.

Figure 14:
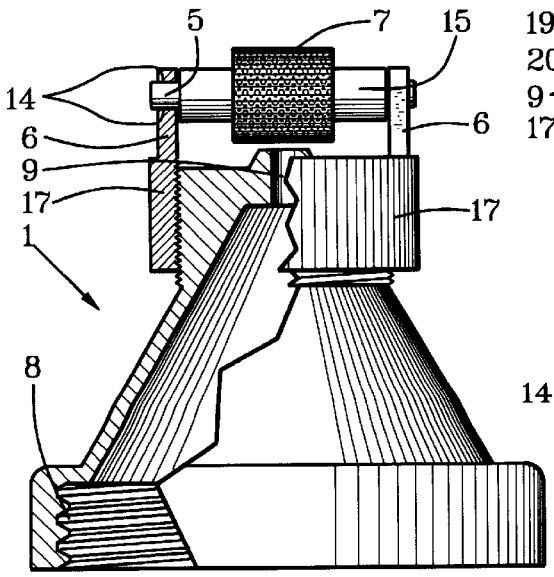
FIG. 14 is a partially cutaway front elevation view of an embodiment with threaded attachment to a container for adjustable wheel-attachment brackets.

Referring to FIG. 14, the wheel-attachment bracket 6 can have closeness-adjustment means for positioning the outside circumferential periphery of the applicator wheel 4 selectively near the applicator nozzle 9. A preferred closeness-adjustment means is machine-threaded attachment 17 of the wheel-attachment bracket 6 to the fluid-conveyance cap 1. This allows applicator wheels 4 with large and small diameters to be positioned with equal closeness to the applicator nozzle 9. Other closeness-adjustment means, such as non-threaded telescopic positioning of the wheel-attaclhment bracket 6 on the fluid-conveyance cap 1 and slotted extension of the wheel-attachment bracket 6 are foreseeable within the scope of this invention.

Figure 15:
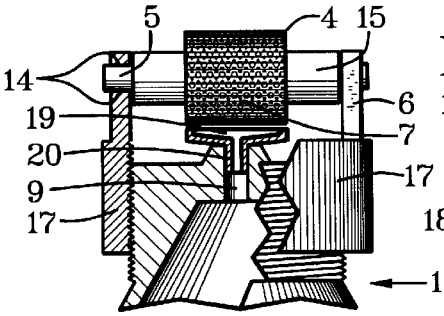
FIG. 15 is a partially cutaway view of a nozzle portion of the FIG. 14 illustration having wheel-attaclhment brackets adjusted further from an applicator nozzle for use of applicator wheels having larger diameters and having a wide flow controller.
Figure 16:
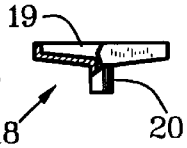
FIG. 16 is a partially cutaway front view of a wide flow controller.

Referring to FIGS. 15–16, the applicator nozzle 9 can have width-adjustment means. A preferred width-adjustment means is a plurality of nozzle-width inserts 18 that have a select range of widths of outlet-width orifices 19 on nozzle-width insert tubes 20 having outside peripheries that fit snugly inside of an inside periphery of a throat of the applicator nozzle 9. The nozzle-width insert tubes 20 have inside peripheries in fluid communication intermediate an inside portion of the fluid-conveyance cap 1 and the outlet-width orifices 19.

Figure 17:
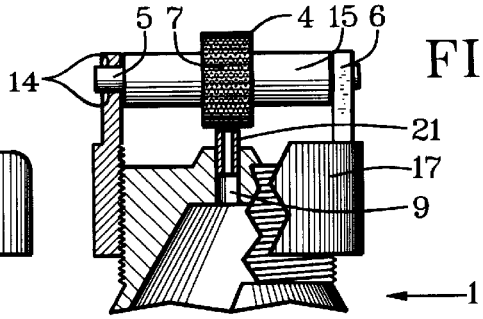
FIG. 17 is a partially cutaway view of a nozzle portion of the FIG. 14 illustration having wheel-attachment brackets adjusted further from an applicator nozzle for use of applicator wheels having larger diameters and having a narrow flow controller.

The width-adjustment means can be employed either with wheel-attachment brackets 6 having closeness adjustment as described in relation to FIGS. 14–15 and 17 or with wheel-attachment brackets 6 having fixed closeness as described in relation to FIGS. 1–4.

Figure 18:
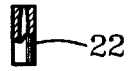
FIG. 18 is a partially cutaway view of the tip of an alternative form of the nozzle.

Referring to FIGS. 17–18, the applicator nozzle 9 can have flow-control means. A preferred flow-control means is a plurality of flow-control inserts, such as a first flow-control insert 21 and a second flow-control insert 22, having internal peripheries with a select range of diameters and circumferential external peripheries that fit removably into an internal periphery of the applicator nozzle 9.

Lengths of the flow-control inserts 21 and 22 also can be varied to provide closeness adjustment of the wheel-attachment bracket 6 to outlet of liquid from the applicator nozzle 9 independently of closeness adjustment described in relation to FIG. 14. Additionally for nozzle-output positioning, depth of telescopic extension of flow-control inserts such as 21 and 22 into and out from the applicator nozzle 9 and the fluid-conveyance cap 1 can be adjustable for adjustment of closeness of an applicator wheel 4 to flow of fluid from the applicator nozzle 9. This can be independent of or in combination with other adjustment of closeness of nozzle output to the applicator wheel 4.

While applicable particularly well to applying grout-sealant liquid, applicator-wheel 4 adjustability of surface characteristics, size and distance from the applicator nozzle 9 in combination with flow control render this invention better suitable to paint stripping also than conventional paint strippers.

A new and useful grout-sealant-liquid applicator having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A grout-sealant-liquid applicator comprising:

a fluid-conveyance cap having a container end and an applicator end;

a wheel-attachment bracket on the applicator end of the fluid-conveyance cap;

at least one applicator wheel positioned concentricly and centrally on at least one applicator axle;

axle bays as wheel-attachment means with which the applicator axle is snap-attached detachably to the wheel-attachment bracket;

a liquid-conveyance surface on an outside circuferential periphery of the applicator wheel;

an applicator nozzle in the applicator end of the fluid-conveyance cap at a select position near the liquid-conveyance surface on the outside circumferential periphery of the applicator wheel;

a plurality of applicator wheels having respective application axles and having select widths, diameters and liquid-conveyance surfaces on outside circumferential peripheries thereof, each of which can be attached to the wheel-attachment means by detachable attachment of the applicator axle to the wheel-attachment bracket.

2. A grout-sealant-liquid applicator as described in claim 1 and further comprising:

a nozzle-output-positioning means with which nearness of output of fluid from the applicator nozzle to the applicator wheel is adjustable selectively.

3. A grout-sealant-liquid applicator comprising:

a fluid-conveyance cap having a container end and an applicator end;

a wheel-attachment bracket on the applicator end of the fluid-conveyance cap;

at least one applicator wheel positioned concentricly and centrally on at least one applicator axle;

axle bays as wheel-attachment means with which the applicator axle is snap-attached detachably to the wheel-attachment bracket;

a liquid-conveyance surface on an outside circuferential periphery of the applicator wheel;

an applicator nozzle in the applicator end of the fluid-conveyance cap at a select position near the liquid-conveyance surface on the outside circumferential periphery of the applicator wheel wherein the wheel-attachment bracket has closeness-adjustment means for positioning the outside circumferential periphery of the applicator wheel selectively near the applicator nozzle in which the closeness-adjustment means is a machine-threading attachment of the wheel-attachment bracket to the fluid-conveyance cap, and the applicator nozzle has a width-adjustment means wherein the width-adjustment means is a plurality of nozzle-width inserts, the nozzle-width inserts have a select range of widths of outlet-width orifices;

the nozzle-width inserts have nozzle-width insert tubes with outside peripheries that fit removably inside of an inside periphery of an applicator nozzle, and the nozzle-width insert tubes have inside peripheries in fluid communication intermediate an inside portion of the fluid-conveyance cap and the outlet-width orifices.

4. A grout-sealant-liquid applicator comprising:

a fluid-conveyance cap having a container end and an applicator end;

a wheel-attachment bracket on the applicator end of the fluid-conveyance cap;

at least one applicator wheel positioned concentricly and centrally on at least one applicator axle;

axle bays as wheel-attachment means with which the applicator axle is snap-attached detachably to the wheel-attachment bracket; a liquid-conveyance surface on an outside circuferential periphery of the applicator wheel; an applicator nozzle in the applicator end of the fluid-conveyance cap at a select position near the liquid-conveyance surface on the outside circumferential periphery of the applicator wheel in which the applicator nozzle has a flow control means and the flow-control means is a plurality of flow-control inserts, and the flow-control inserts have internal peripheries with a select range of diameters and a circumferential external periphery that fits removably into an internal periphery of the applicator nozzle.

5. A method comprising the following steps for using a grout-sealant-liquid applicator:

providing a liquid applicator having a fluid-conveyance cap with a container end and an applicator end; a wheel-attachment means with a bracket on the applicator end of the fluid-conveyance cap, one applicator wheel positioned concentrically and centrally on one applicator axle; the applicator wheel being one of a plurality of applicator wheels having respective application axles and having select widths, diameters and liquid conveyance surfaces on outside circumferential peripheries thereof such that the aforesaid applicator wheels having select widths, diameters and liquid conveyance surfaces on outside circumferential peripheries thereof can be attached to the wheel-attachment means by detachable attachment of the applicator axle to the wheel-attachment bracket; and an applicator nozzle in the applicator end of the fluid-conveyance cap at a select position near the liquid-conveyance surface on the outside circumferential periphery of the applicator wheel;

selecting an applicator wheel having a desired width, diameter and liquid-conveyance surface on an outside circumferential periphery thereof for a particular surface;

attaching the select applicator wheel positioned on an applicator axle to the wheel-attachment means;

attaching the fluid-conveyance cap to a desired fluid container;

applying desired liquid by rolling the applicator wheel along a top of a particular surface; removing the select applicator wheel; and repeating the above steps for applying desired liquid to other particular surfaces.

6. A method as described in claim 5 wherein:

the applicator wheel has a diameter that is different from a diameter of a previous applicator wheel for applying liquid to a different surface and the liquid applicator has a nozzle-positioning means with which nearness of the applicator nozzle to the applicator wheel is adjustable selectively; and including the additional step of:

adjusting nearness of the applicator nozzle to the applicator wheel before rolling the applicator wheel along the different surface.

7. A method as described in claim 5 wherein:

the applicator nozzle has a width-adjustment means; and including the additional step of:

adjusting width of the applicator nozzle before rolling the applicator wheel along the different surface.

* * * * *